US005507712A

United States Patent [19]

Chang

[11] Patent Number: 5,507,712

[45] Date of Patent: Apr. 16, 1996

[54] MULTIPURPOSE EXERCISING APPARATUS

[76] Inventor: John Chang, No. 1-2, Lane 975, Chun-Jih Road, Tao-Yuan City, Taiwan

[21] Appl. No.: 502,356

[22] Filed: Jul. 14, 1995

[51] Int. Cl.[6] ..... A63B 21/02

[52] U.S. Cl. ..... 482/126; 482/127

[58] Field of Search ..... 482/121, 122, 482/126, 44, 127

[56] References Cited

U.S. PATENT DOCUMENTS

| | | | |
|---|---|---|---|
| 4,465,276 | 8/1984 | Cox | 482/126 |
| 5,026,050 | 6/1991 | Levny et al. | 482/126 |
| 5,267,929 | 12/1993 | Chen | 482/126 |
| 5,399,138 | 3/1995 | Jones | 482/126 |
| 5,413,548 | 5/1995 | Hoffman | 482/126 |

*Primary Examiner*—Lynne A. Reichard
*Attorney, Agent, or Firm*—Morton J. Rosenberg; David I. Klein

[57] ABSTRACT

A multipurpose exercising apparatus including two symmetrical actuating devices, each actuating device having a cylindrical casing at one end and a circular coupling at an opposite end, a connecting device to revolvably connect the circular couplings of the actuating devices together, two first extension tubes slidably fastened to the cylindrical casings of the actuating devices, two second extension tubes slidably fastened to the first extension tubes, two handles respectively coupled to the second extension tubes, two expansion springs respectively connected between the circular couplings of the actuating devices and the handles, and locks respectively mounted on the actuating devices for locking the first and second extension tubes inside the cylindrical casings of the actuating devices.

7 Claims, 15 Drawing Sheets

MULTIPURPOSE EXERCISING APPARATUS

BACKGROUND OF THE INVENTION

The present invention relates to exercising apparatus for exercising the body, and relates more particularly to a multipurpose exercising apparatus which combines a chest expander and a fitness bender into a handy unit.

A variety of handy personal exercising apparatus including chest expander A (see FIG. 1), fitness bender B (see FIG. 2), hand grip, tension bar, etc., have been disclosed for exercising the muscles of different parts of the body, and have appeared on the market. These apparatus are designed for a specific purpose, i.e., for exercising the muscles of a specific part of the body. Therefore, several exercising apparatus shall have to prepare when to exercise different parts of the body. However, it is not economic to prepare several exercising apparatus for exercising the muscles of the body. When several exercising apparatus are prepared, much storage space is required. Besides, one will be quickly tired with constantly using the same exercising apparatus. Furthermore, constantly using a specific exercising apparatus to exercise a specific part of the body, the muscles of the body cannot be developed evenly.

SUMMARY OF THE INVENTION

The present invention has been accomplished under the circumstances in view. It is one object of the present invention to provide a multipurpose exercising apparatus which combines a chest expander and a fitness bender into a handy unit. It is another object of the present invention to provide a multipurpose exercising apparatus whose handle length can be conveniently adjusted to fit persons of different sizes. It is still another object of the present invention to provide a multipurpose exercising apparatus whose elasticity and twisting resistance can be conveniently adjusted to fit different demands for different exercising amounts.

DETAILED DESCRIPTION OF THE PREFERRED EMBODIMENT

Figure 1:
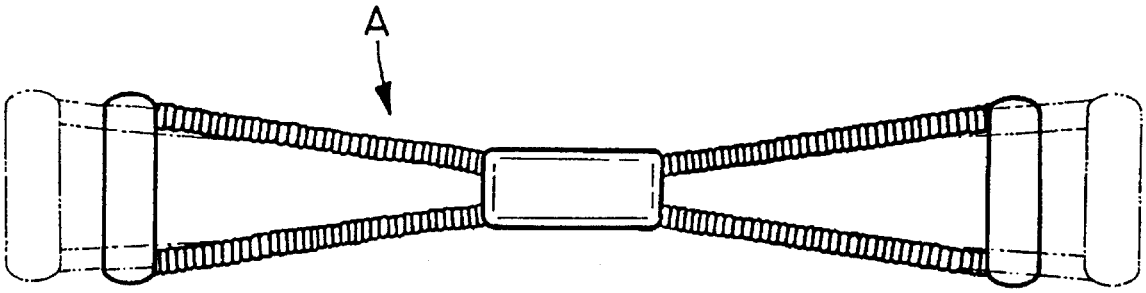
PRIOR ART FIG. 1
FIG. 1 shows a chest expander according to the prior art.
Figure 2:
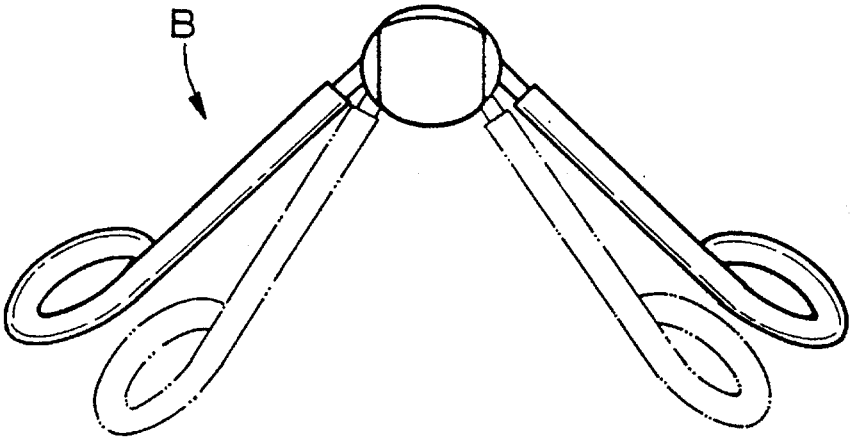
PRIOR ART FIG. 2
FIG. 2 shows a fitness bender according to the prior art.
Figure 3:
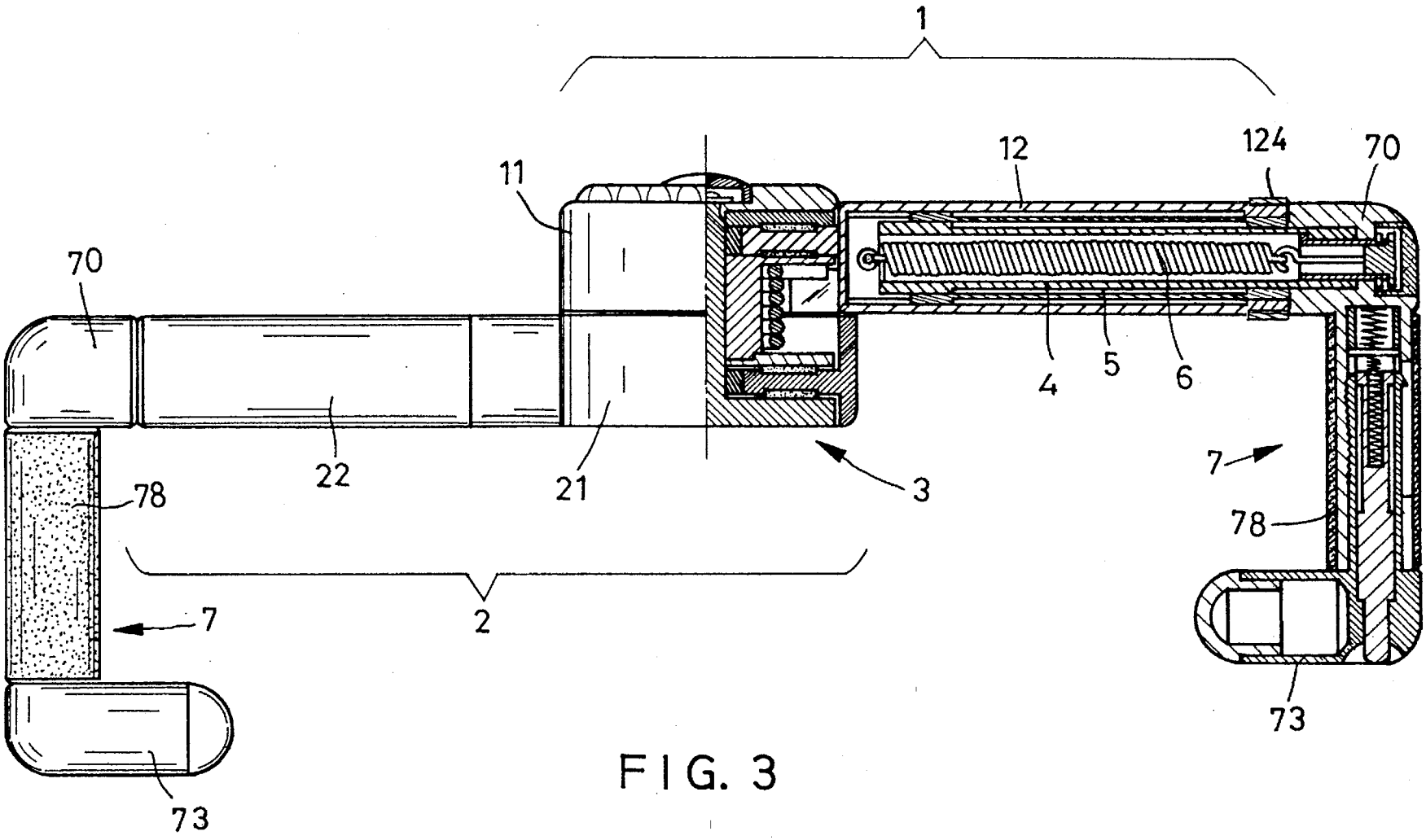
FIG. 3 shows a multipurpose exercising apparatus according to the present invention.
Figure 4:
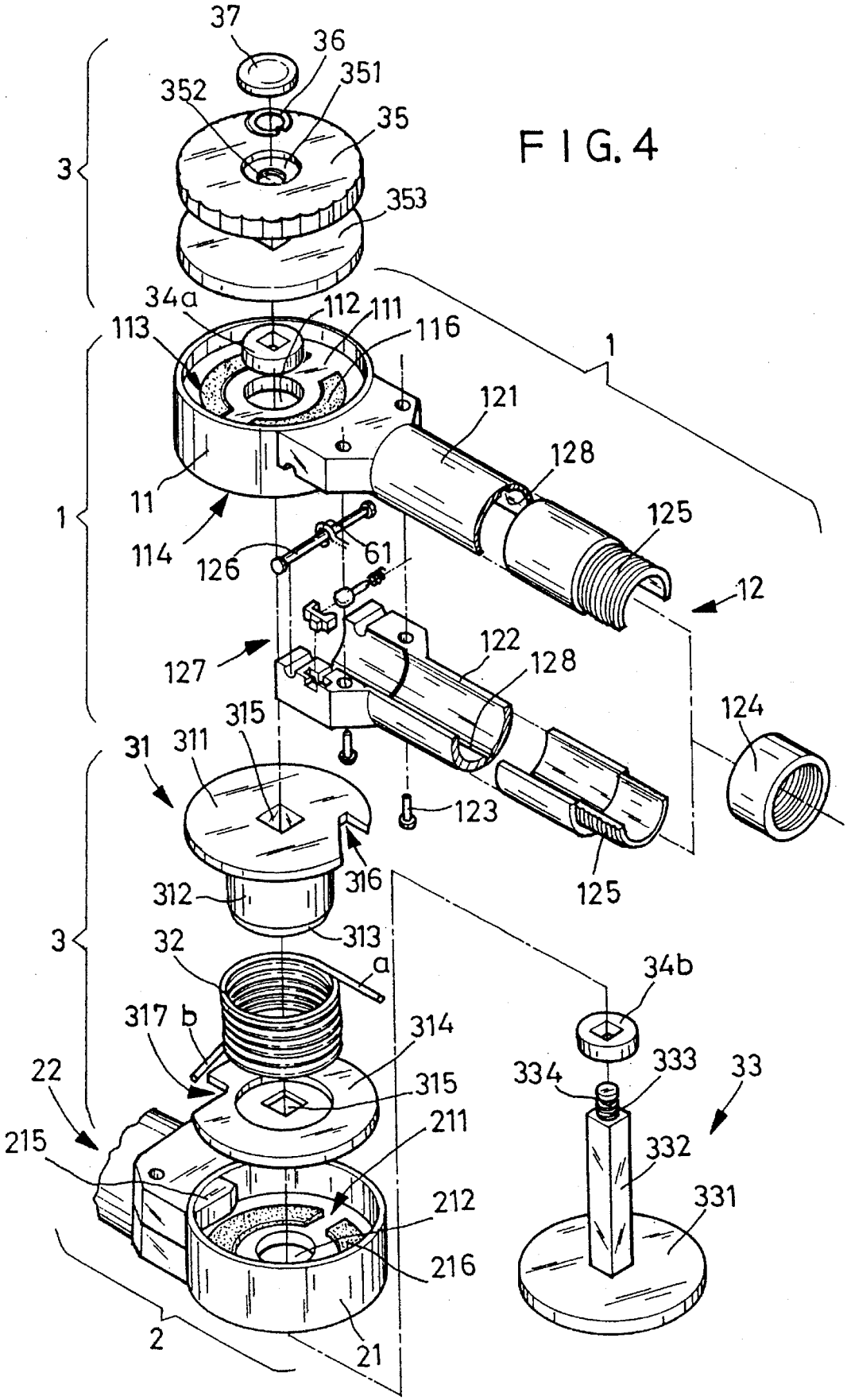
FIG. 4 is an exploded view of the actuating devices and the connecting device according to the present invention.
Figure 5:
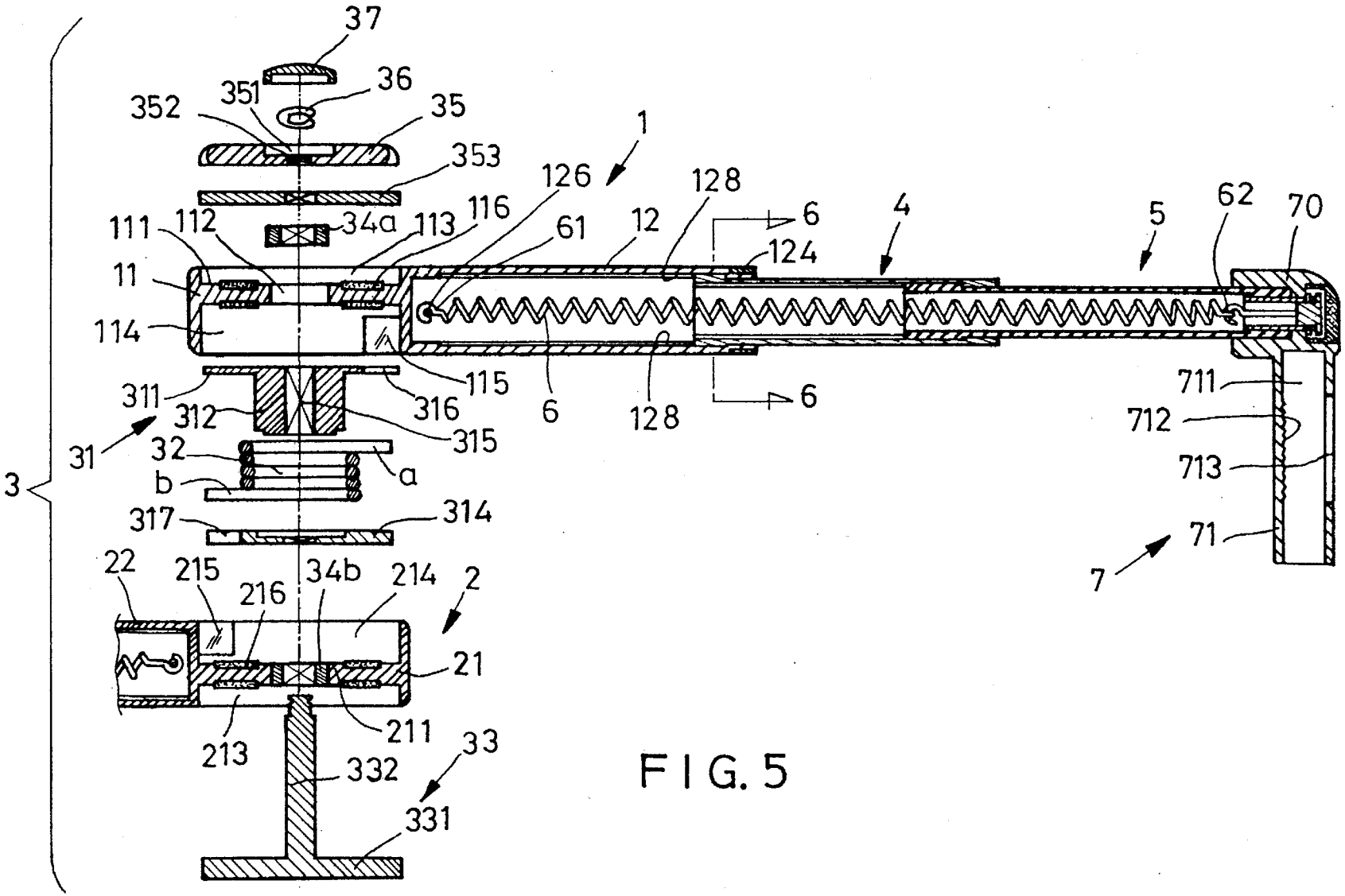
FIG. 5 is a partial view in section of the multipurpose exercising apparatus according to the present invention, showing the first extension tube and the second extension tube extended out.

Referring to FIGS. 3, 4, and 5, a multipurpose exercising apparatus in accordance with the present invention is generally comprised of a first actuating device 1, a second actuating device 2, a connecting device 3, a pair of first extension tubes 4, a pair of second extension tubes 5, two expansion springs 6, and two handles 7. The first actuating device 1 comprises a cylindrical casing 12 and a circular coupling 11 at one end of the cylindrical casing 12. The circular coupling 11 comprises a partition wall 111, a center axle hole 112 through the center of the partition wall 111, an outer chamber 113 and an inner chamber 114 separated by the partition wall 111, a stop block 115 inside the inner chamber 114. The second actuating device 2 is symmetrical to the first actuating device 1 but disposed in the reversed direction, comprised of a cylindrical casing 22 and a circular coupling 21 at one end of the cylindrical casing 22, which circular coupling 21 has a partition wall 211 and a center axle hole 212. The connecting device 3 connects the circular couplings 11 and 21 together, comprised of a locating device 31, a coil spring 32, a connecting bolt 33, two axle bushes 34*a* and 34*b*, an adjusting knob 35, a clamp 26, and a cap 37. The locating device 31 comprises a circular head 311, a shank 312 perpendicularly extended from the center of the circular head 311 and inserted through the coil spring 32 and terminating in a reduced end 313, a circular end plate 314 coupled to the reduced end 313 of the shank 312 and disposed in parallel to the circular head 311, a square center through hole 315 through the head 311, the shank 312, and the end plate 314. The connecting bolt 33 comprises a circular head 331 stopped against the partition wall 211 of the circular coupling 21 of the second actuating device 2 at an outer side, a square shank 332 perpendicularly extended from the center of the circular head 331 and inserted through the center axle holes 212 and 112 of the circular couplings 21 and 11 and the square center through hole 315 of the locating device 31, and a screw rod 333 longitudinally extended from the square shank 332 and having an annular groove 334 around the periphery. The axle bushes 34*a* and 34*b* are respectively mounted within the axle holes 112 and 212 around the square shank 332 of the connecting bolt 33. The adjusting knob 35 comprises a circular top recess 351 at the center of the top side thereof, and a screw hole 352 at the center of the circular top recess 351. When the shank 332 of the connecting bolt 33 is inserted through the center axle holes 212 and 112 of the circular couplings 21 and 11 and the square center through hole 315 of the locating device 31, the adjusting knob 35 is threaded onto the screw rod 333 of the connecting bolt 33 by engaging the screw hole 352 with the screw rod 333, then the clamp 36 is fastened to the annular groove 334, and then the plastic cap 37 is fitted into the circular top recess 351 to cover the screw rod 33 of the connecting bolt 33. There is also provided a gasket 353 mounted around the shank 332 of the connecting bolt 33 and retained between the circular coupling 11 of the first actuating device 1 and the adjusting knob 35. The first extension tubes 4 are respectively and slidably inserted into the cylindrical casings 12 and 22 of the actuating devices 1 and 2. The second extension tubes 5 are respectively and slidably inserted into the first extension tubes 4. The handles 7 are respectively coupled to the second extension tubes 5 opposite to the first extension tubes 4, and disposed in parallel to each other. The expansion springs 6 are respectively inserted through the first extension tubes 4 and the second extension tubes 5, and connected between the actuating devices 1 and 2 and the handles 7.

Referring to FIGS. 4 and 5 again, resistance strips 116 and 226 are respectively and fixedly secured to both sides of the partition walls 111 and 211. The circular head 311 of the locating device 31 has a notch 316 corresponding to the stop block 115 of the circular coupling 11 of the first actuating device 1. The circular end plate 314 has a notch 317 corresponding to the stop block 215 of the circular coupling 21 of the second actuating device 2. The cylindrical casing 12 is comprised of two half-round tubes, namely, the upper half-round tube 121 and the lower half-round tube 122. The upper half-round tube 121 is integrally connected to the circular coupling 11. The lower half-round tube 122 is fixed to the upper half-round tube 121 by screws 123. The half-round tubes 121 and 122 have a respective threaded portion 125. When the half-round tubes 121 and 122 are connected together, a nut 124 is threaded onto the threaded portions 125 of the half-round tubes 121 and 122. Before threading the nut 124 onto the threaded portions 125, the respective extension tubes 4 and 5 must be inserted into the cylindrical casing 12. A locating rod 126 is transversely connected between the half-round tubes 121 and 122 adjacent to the circular coupling 11 to hold one end 61 of the respective expansion spring 6. A lock 127 is mounted on the cylindrical casing 12 adjacent to the locating rod 126, and controlled to lock the respective extension tubes 4 and 5 in position (this will be described further). The cylindrical casing 22 of the second actuating device 2 is identical to that of the first actuating device 1.

Figure 6:
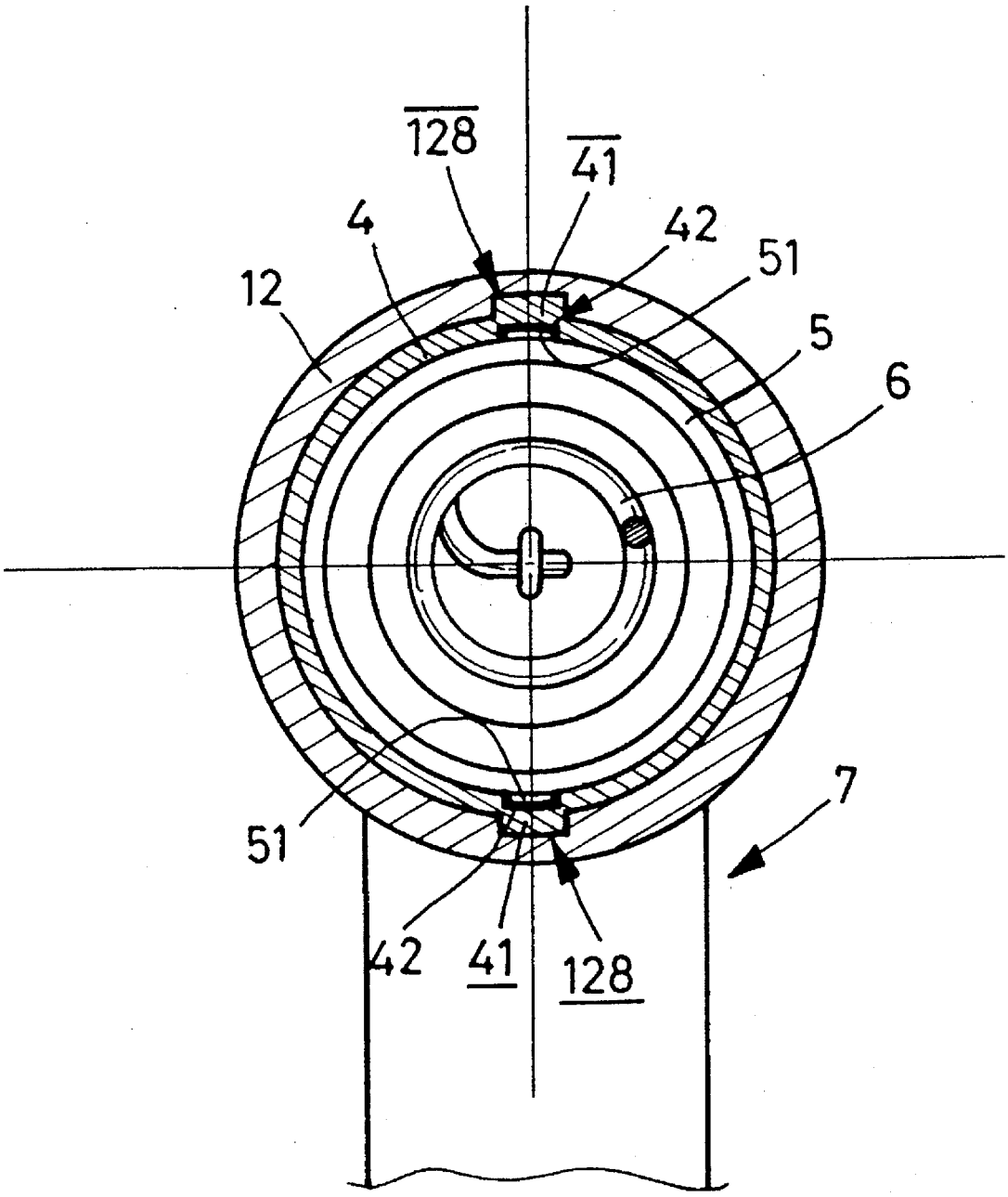
FIG. 6 is a sectional view taken along line 6—6 of FIG. 5.

Referring to FIG. 6 and FIG. 5 again, the cylindrical casing 12 has two longitudinal sliding grooves 128 on the inside. The first extension tube 4 comprises two longitudinal ribs 41 on the outside respectively moved in the longitudinal sliding grooves 128, and two longitudinal sliding grooves 42 on the inside for the sliding of the second extension tube 5. The second extension tube 5 has two longitudinal ribs 51 on the outside respectively moved in the sliding grooves 42 on the first extension tube 4. Therefore, the first extension tube 4 can be moved in and out of the cylindrical casing 12, and the second extension tube 5 can be moved in and out of the first extension tube 4. Because the respective longitudinal ribs 41 and 51 are respectively and slidably engaged in the respective longitudinal sliding grooves 128 and 42, the extension tubes 4 and 5 are prohibited from rotary motion relative to the cylindrical casing 12.

Figure 8:
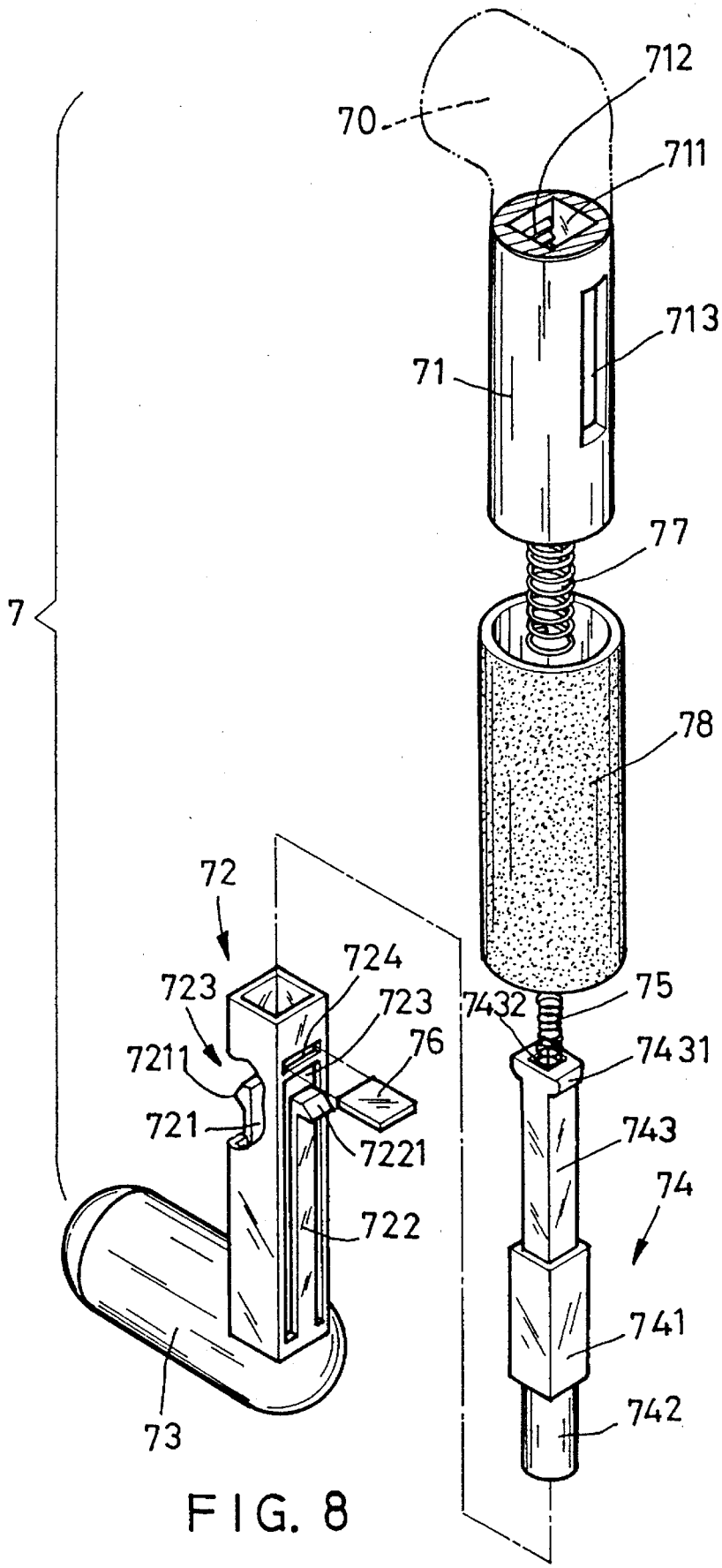
FIG. 8 is an exploded view of one handle of the multipurpose exercising apparatus according to the present invention.
Figure 9:
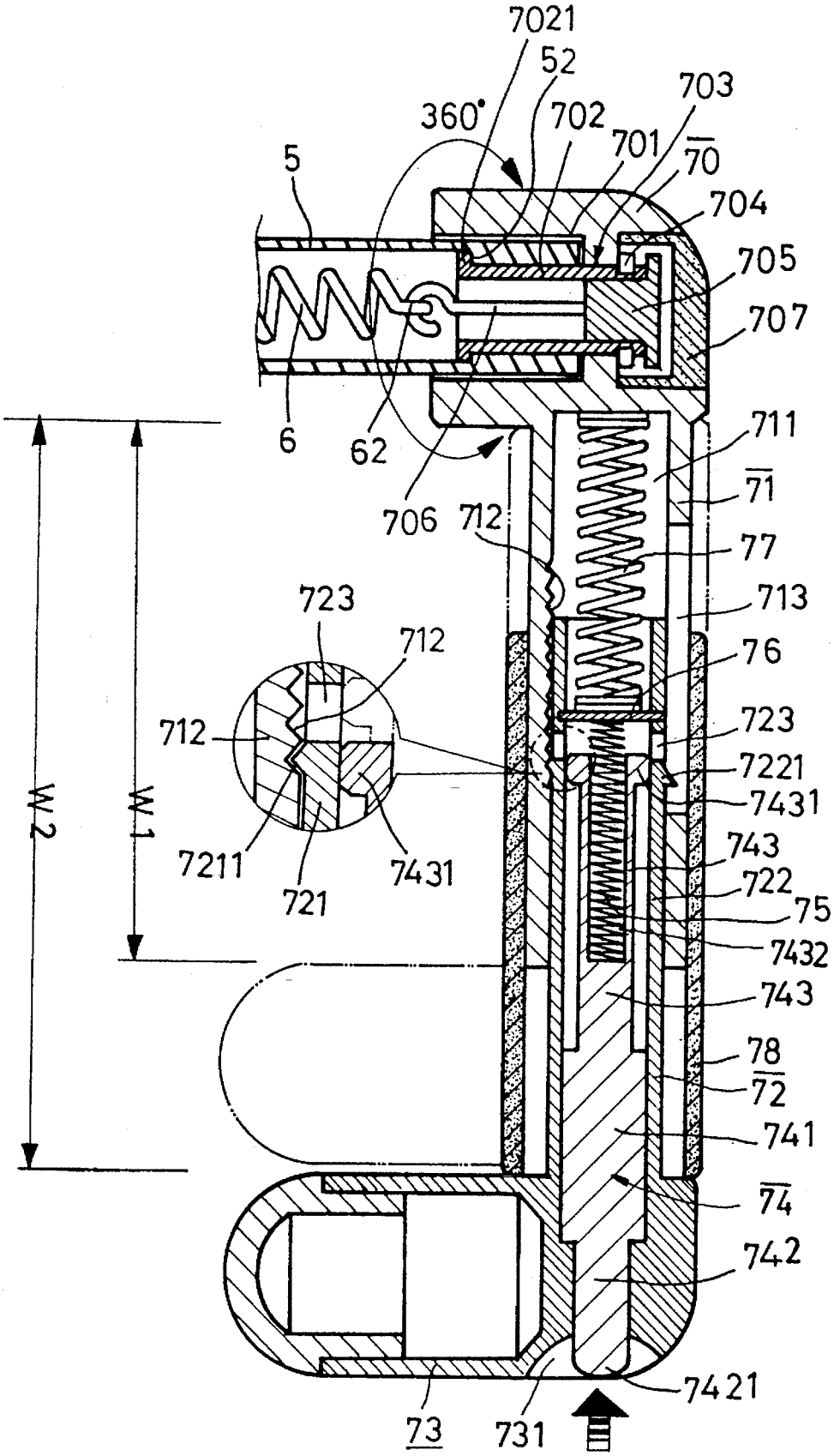
FIG. 9 is a sectional assembly view of the handle shown in FIG. 8.

Referring to FIGS. 8 and 9, the handle 7 comprises a coupling tube 71, a square extension tube 72, an adjusting bar 74, an expansion spring 77, and a sleeve 78. The coupling tube 71 has a coupling end 70 at right angles for coupling to one second extension tube 5, a longitudinal square hole 711, a toothed portion 712 at one side of the longitudinal square hole 711, and a longitudinal side opening 713 communicated with the longitudinal square hole 711. The square extension tube 72 is inserted into the longitudinal square hole 712 of the coupling tube 71, having one end terminating in rounded locating rod 73 at right angles stopped outside the coupling tube 71. The extension tube 72 comprises two longitudinal side openings 723 at two opposite sides, a first projecting strip 721 upwardly suspended in one side opening 723 and having a hooked top end 7211 for engagement with the toothed portion 712, a second projecting strip 722 upwardly suspended in one side opening 723 opposite to the first projecting strip 721 and having a hooked top end 7221, a transverse slot 724 above one side opening 723, and a locating plate 724 inserted into the transverse slot 724. The adjusting bar 74 is inserted into the square extension tube 72, comprised of a square rod body 743 at one end, a rounded stop rod section 742 at an opposite end, and an outward square flange 741 in the middle, The square rod body 743 of the adjusting bar 74 has a head 7431 and a longitudinal hole 7432 at the center of the head 7431. A spring 75 is mounted in the longitudinal hole 7432 and stopped below the locating plate 76. The expansion spring 77 is mounted in the longitudinal square hole 711 of the coupling tube 71 and stopped above the locating plate 76. The sleeve 78, which can be a rigid tube covered with a flexible covering, is loosely mounted around the coupling tube 71.

Referring to FIG. 9 again, the handle 7 is coupled to one second extension tube 5 by the coupling end 70 of its coupling tube 71. The coupling end 70 defines a coupling hole 701, which receives the second extension tube 5. A connecting tube 702 is inserted through the coupling hole 701 into an inside annular flange 703 inside the coupling hole 701, having an outward flange 7021 at one end engaged with an inward flange 52 at one end of the second extension tube 5, and an opposite end retained in place by a clamp 704. When connected, the coupling end 70 can be turned relative to the second extension tube 5. An end cap 705 is fastened to the connecting tube 702 inside the coupling end 70 of the coupling tube 71, having a hanger 706 disposed inside the connecting tube 702 to hold the opposite end 62 (opposite to the end 61) of the expansion spring 6. When assembled, a plastic cap 707 is fastened to the coupling end 70 to close the coupling hole 701.

Figure 7:
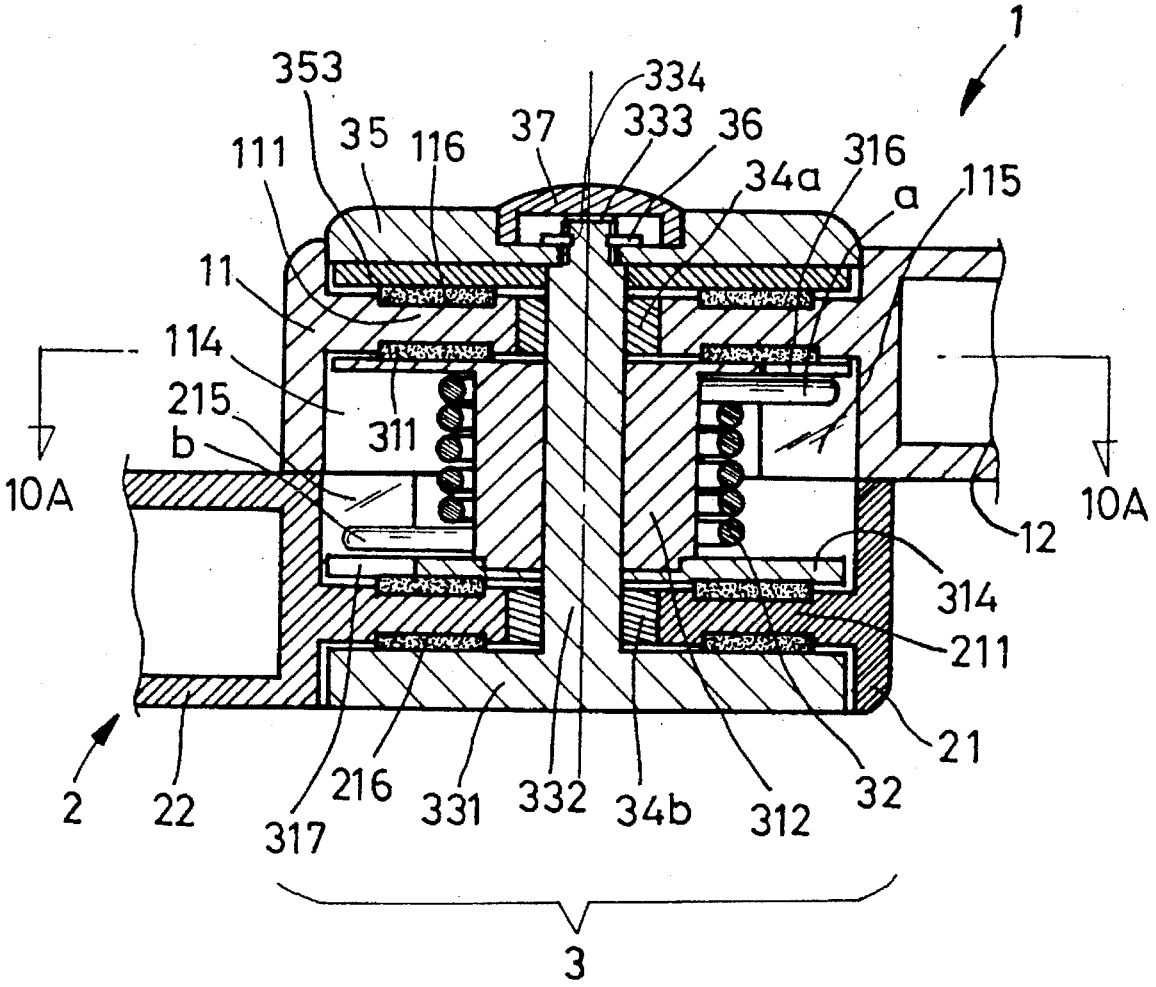
FIG. 7 is a sectional view showing the actuating devices connected together by the connecting device according to the present invention.

Referring to FIG. 7, the square shank 332 of the connecting bolt 33 is inserted in proper order through the circular coupling 21 of the second actuating device 2, the circular end plate 314 and shank 312 of the locating device 31, the circular coupling 11 of the first actuating device 1, and the gasket 353, then the adjusting knob 35 is threaded onto the screw rod 333 of the connecting bolt 33, and then the clamp 36 is fastened to the annular groove 334 of the screw rod 333 to hold the first actuating device 1 and the second actuating device 2 together. During the assembly process, the axle bushes **34*a* and 34*b* are respectively mounted in the axle hole 112 of the circular coupling 11 of the first actuating device 1 and the axle hole 212 of the circular coupling 21 of the second actuating device 2 around the square shank 332 of the connecting bolt 33. When assembled, the first actuating device 1 and the second actuating device 2 can be turned about the square shank 332 of the connecting bolt 33, however the locating device 31 is prohibited from rotary motion relative to the connecting bolt 33 because its square center through hole 315 is engaged with the square shank 332 of the connecting bolt 33. The coil spring 32 is mounted around the shank 312 of the locating device 31, having one end "a" stopped at the locating block 115 inside the circular coupling 11 of the first actuating device 1, and an opposite end "b" stopped at the locating block 215 inside the circular coupling 21 of the second actuating device 2. The tightness between the circular couplings 11 and 12 can be adjusted by turning the adjusting knob 35. When the adjusting knob 35 is turned in one direction, the head 331 of the connecting bolt 33 and the gasket 353 are forced inwards against the respective resistance strips 216 and 116, and at the same time the head 311 and circular end plate 314 of the locating device 31 are respectively stopped against the respective resistance strips 216 and 116, and therefore the tightness between the circular couplings 11 and 12 is reinforced. On the contrary, when the adjusting knob 35 is rotated in the reversed direction, the tightness between the circular couplings 11 and 12** is relatively loosened.

Figure 10A:
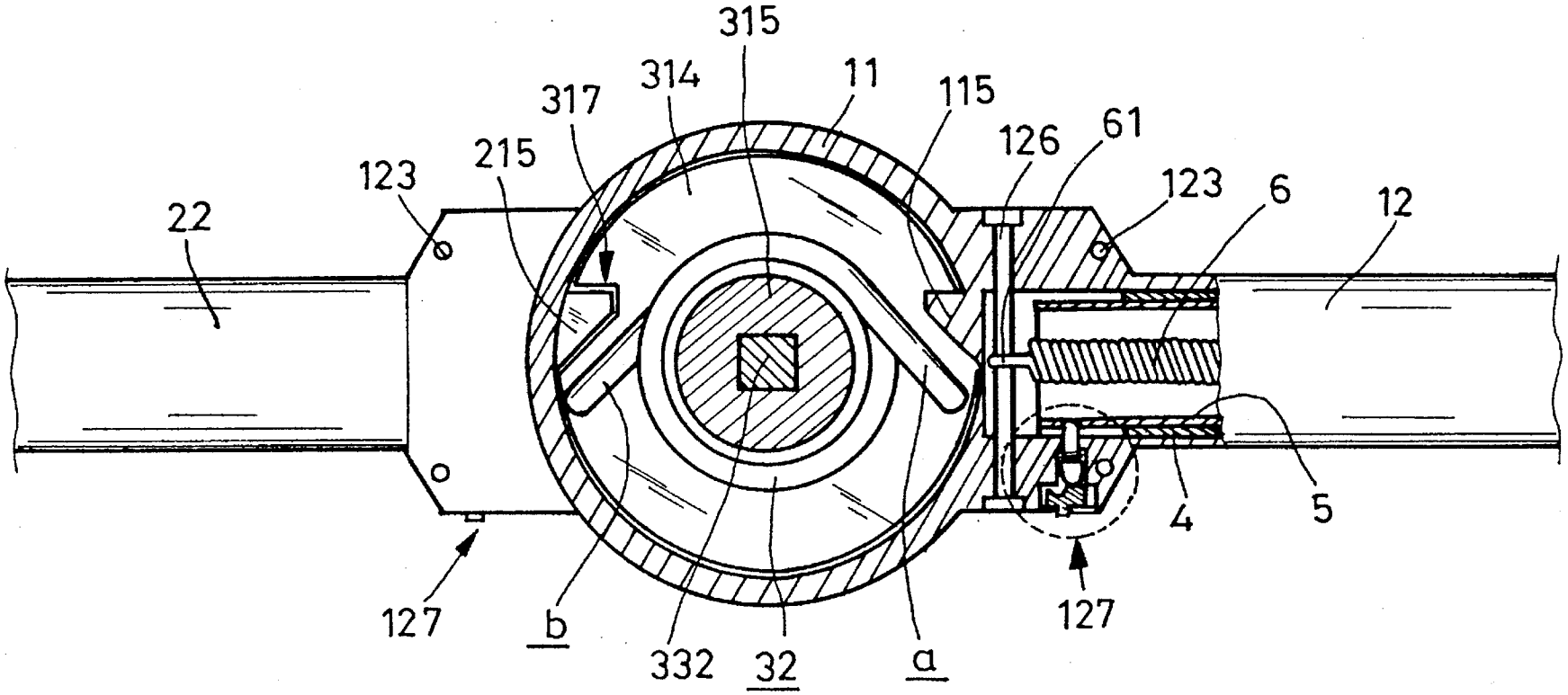
FIG. 10A is a sectional view taken along line 10A—10A of FIG. 3.

Referring to FIG. 10A, when the first actuating device 1 and the second actuating device 2 are bent inwards, the stop blocks 115 and 215 of the circular couplings 11 and 21 are respectively forced against the two opposite ends "a" and "b" of the coil spring 32, causing the coil spring 32 compressed, Therefore, the exercising device can be used as a fitness bender. The actuating devices 1 and 2 can also be bent in the reversed direction. However, when the actuating devices 1 and 2 are bent in the reversed direction, the coil spring 32 will not be compressed, Under this operation mode, damping resistance comes from the friction between the resistance strips 116 and 216 and, the locating device 31 and the connecting bolt 33. The amount of damping resistance can be adjusted by turning the adjusting knob 35.

Figure 10B:
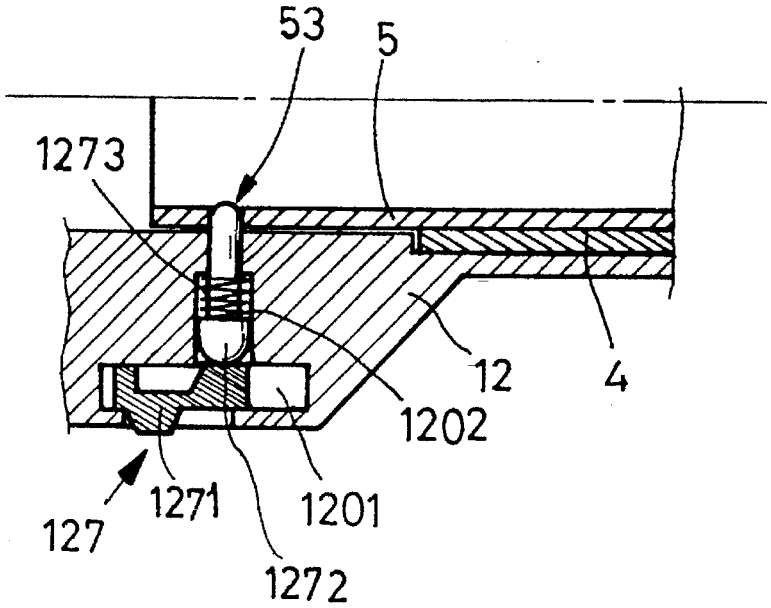
FIG. 10B is a sectional view showing the first and second extension tubes locked according to the present invention.
Figure 10C:
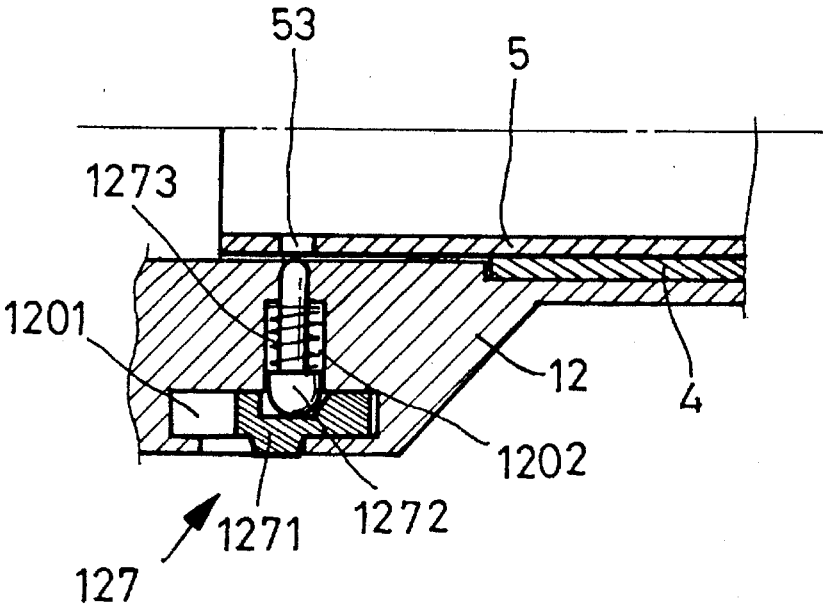
FIG. 10C is a sectional view showing the first and second extension tubes unlocked according to the present invention.

Referring to FIG. 10B, when the exercising apparatus is to be used as a fitness bender, the first and second extension tubes 4 and 5 must be locked inside the cylindrical casings 12 and 22 of the first and second actuating devices 1 and 2 by a respective lock 127. As illustrated in FIG. 10B, the lock 127 comprises a slide 1271 slidably mounted in a sliding groove 1201 on the cylindrical casing 12, a latch bolt 1272 mounted in a countersunk hole 1202 on the sliding groove 1201, and a spring 1273 mounted around the latch bolt 1272 inside the countersunk hole 1202. When the slide 1271 is moved to the locking position, the latch bolt 1272 is forced into a locating hole 53 on the second extension tube 5. Because the first extension tube 4 is mounted around the second extension tube 5, the first extension tube 4 is stopped inside the cylindrical casing 12 when the second extension tube 5 is locked. Referring to FIG. 10C, when the slide 1271 is moved to the unlocking position, the latch bolt 1272 is forced upwards from the locating hole 53 by the spring 1273, and therefore the first extension tube 4 and the second extension tube 5 are released from the lock 127. When the first and second extension tubes 4 and 5 are unlocked, the exercising apparatus can be used as an expander.

Referring to FIGS. 8 and 9 again, the length of the handle 7 can be adjusted as desired. The spring 75, which is mounted in the locating hole 7432 and stopped against the locating plate 76, gives a downward pressure to the adjusting bar 74. Therefore, the rounded stop rod section 742 of the adjusting bar 74 is forced out of a bottom recessed hole 731 on the locating rod 73, and the head 7431 of the adjusting bar 74 is stopped between the first projecting strip 721 and the second projecting strip 722, causing the hooked top end 7211 of the first projecting strip 721 engaged with the toothed portion 712 of the coupling tube 71. The hooked top end 7221 of the second projecting strip 722 projects into the longitudinal side opening 713 of the coupling tube 71 to limit the sliding distance of the extension tube 72 in the coupling tube 71. When the bottom end 7421 of the rounded stop rod section 742 is depressed, the head 7431 of the square rod body 743 is moved upwards from the first projecting strip 721 and the second projecting strip 722, thereby rendering the extension tube 72 to be moved in the longitudinal square hole 711 of the coupling tube 71. When the rounded stop rod section 742 is released from the hand, the spring 75 forces the adjusting bar 74 back to its former position, and therefore the hooked top end 7211 of the first projecting strip 721 is forced into engagement with the toothed portion 712 of the coupling tube 71 again. Therefore, the pitch between the coupling end 70 and the locating rod 73 can be adjusted between the minimum pitch W1 and the maximum pitch W2. The user can adjust the pitch to fit the hand or the leg. The sleeve 78 is loosely mounted around the coupling tube 71 for the holding of the hand.

Figure 11:
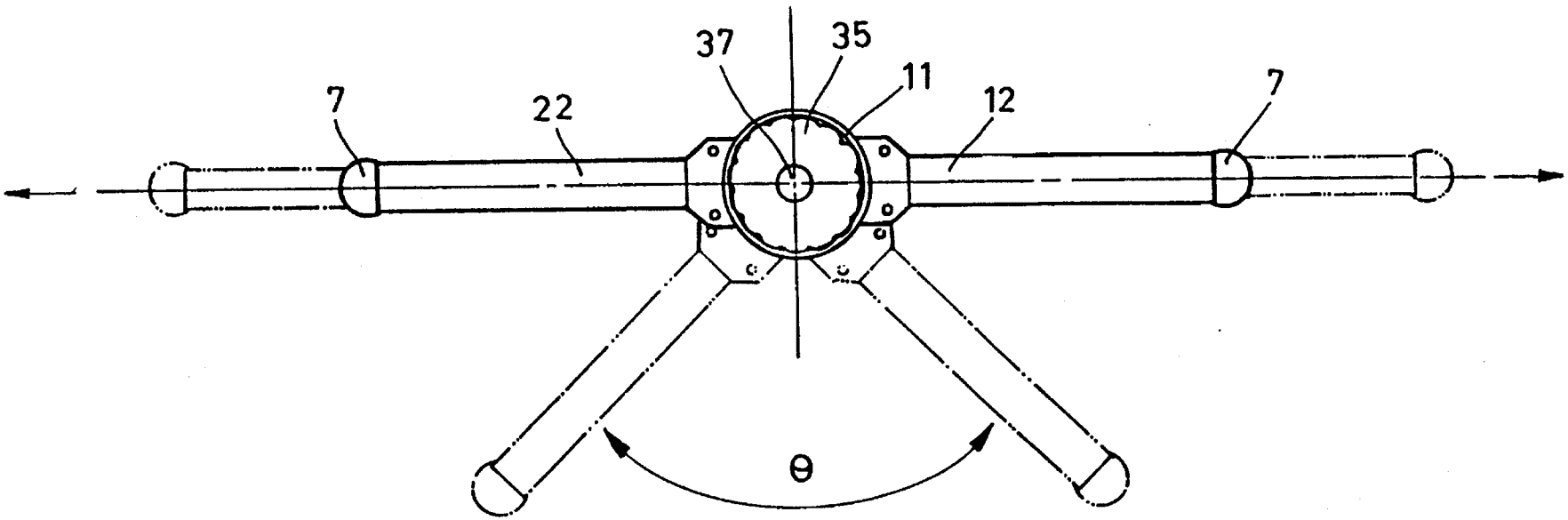
FIG. 11 is a schematic drawing showing the bending and linear stretching operations of the multipurpose exercising apparatus according to the present invention.

Referring to FIG. 11, the cylindrical casings 12 and 22 can be bent inwards by the hands through the handles 7 at an angle $\Theta$, or stretched linearly in reversed directions. The multipurpose exercising apparatus can be operated at different modes to exercise different parts of the body.

OPERATION EXAMPLE I

Figure 12:
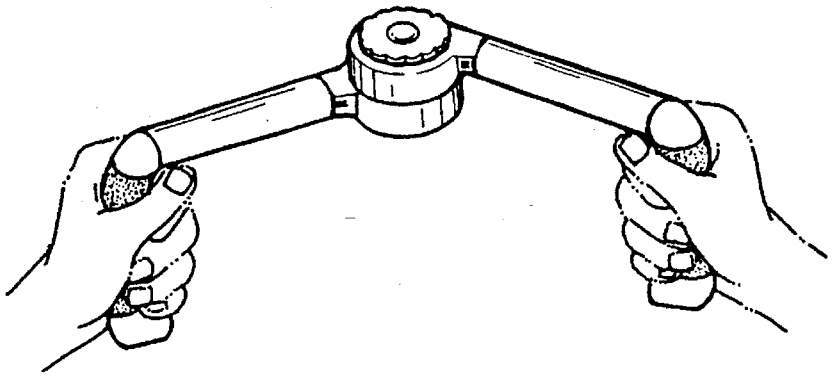
FIG. 12 shows an application example of the present invention used as a fitness bender.

When the first and second extension tubes 4 and 5 are respectively locked in the cylindrical casings 12 and 22 by the respective locks 127, the multipurpose exercising apparatus can then be used as a fitness bender as shown in FIG. 12. When the cylindrical casings 12 and 22 are respectively bent inwards from three o'clock and nine o'clock positions to six o'clock position (Isle also FIG. 10A), the spring 32 is compressed to give a resistance. Therefore, when spring 32 automatically forces the cylindrical casings 12 and 22 back from six o'clock position to the three or nine o'clock position during the return stroke. However, if the cylindrical casings 12 and 22 are respectively bent outwards from three o'clock and nine o'clock positions to twelve o'clock position, the spring 32 does no work. The damping force during the operation of this mode can be adjusted by turning the adjusting knob 35 to change the friction resistance between the connecting device 3 and the resistance strips 116 and 216.

OPERATION EXAMPLE II

Figure 13:
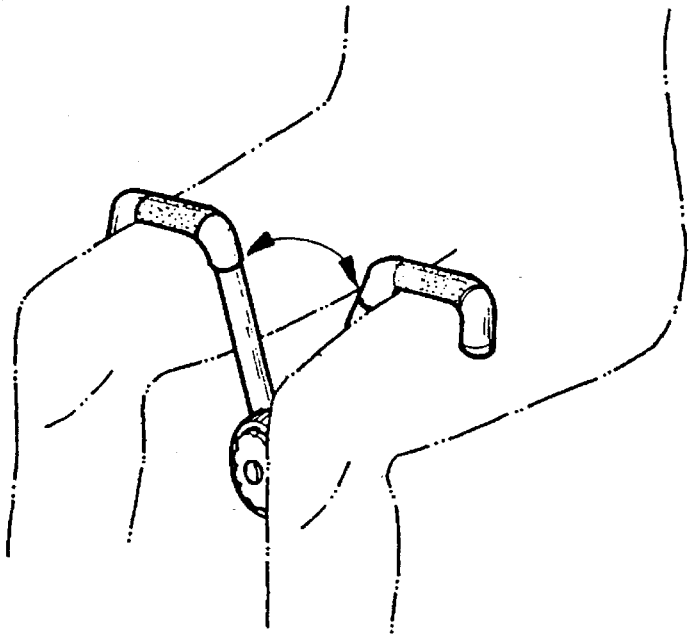
FIG. 13 shows another application example of the present invention used as a thigh weight mounted between the thighs and stretched by the thighs.

As illustrated in FIG. 13, the handles 7 are properly adjusted and then bridged over the thighs, and then the multipurpose exercising apparatus is alternatively stretched and expanded by the thighs to exercise the muscles of the thighs.

OPERATION EXAMPLE III

Figure 14:
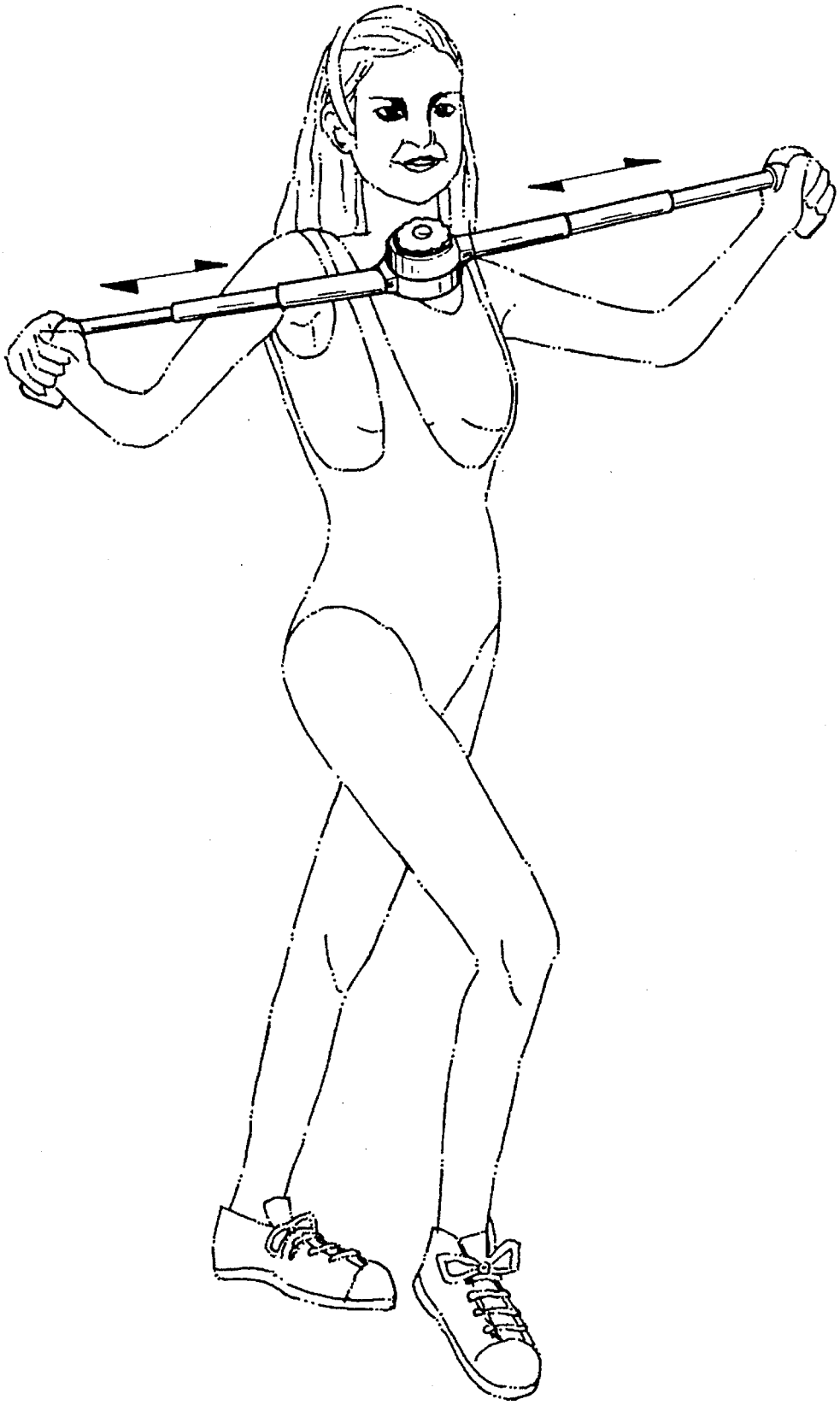
FIG. 14 shows still another application example of the present invention used as a chest expander.

As illustrated in FIG. 14, when the first and second extension tubes 4 and 5 are unlocked from the locks 127, the multipurpose exercising apparatus can be used as a chest expander to exercise the muscles of the chest. When the handles 7 are pulled outwards in reversed directions, the expansion springs 6 are stretched to give a resistance to the hands, and therefore the muscles of the hands and the chest are exercised.

OPERATION EXAMPLE IV

Figure 15:
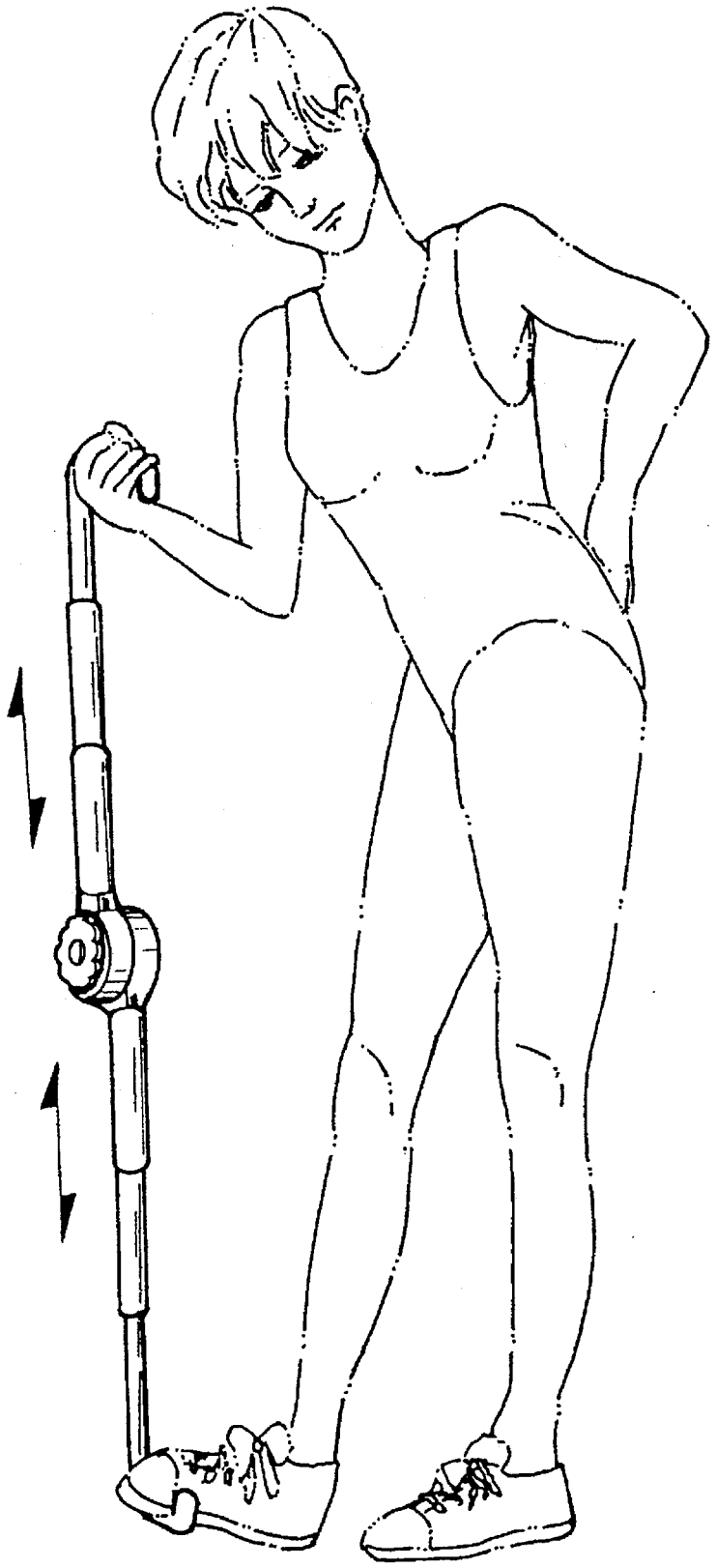
FIG. 15 shows still another application example of the present invention used as an expander and stretched between the leg and the hand.

As illustrated in FIG. 15, one handle 7 is be stepped on the ground by one foot, and the second handle 7 is held in one hand and then pulled when the player stands on the ground.

This operation mode is effective to exercise the muscles of the arms.

OPERATION EXAMPLE V

Figure 16:
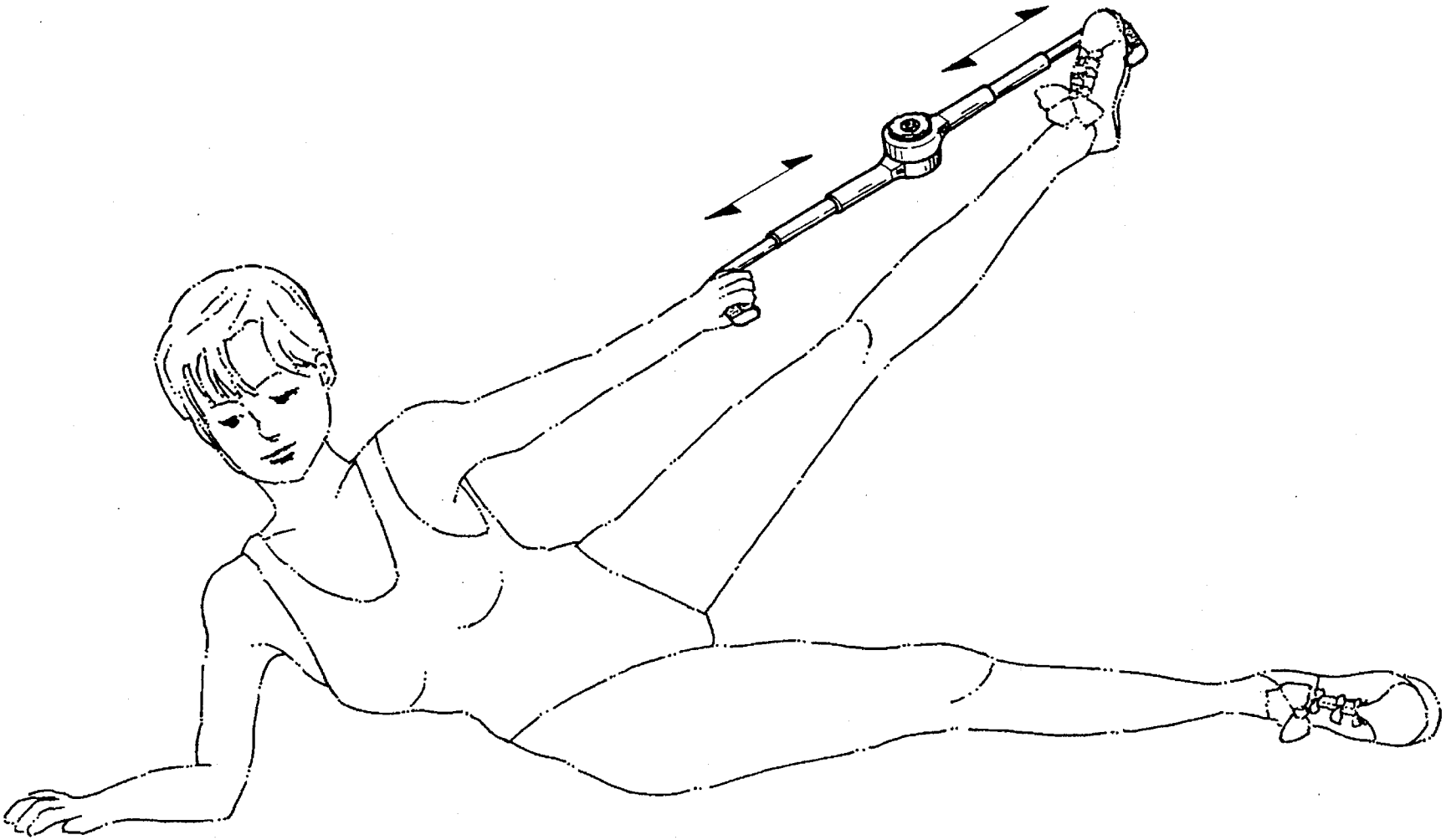
FIG. 16 shows still another application example of the present invention used as an expander and stretched between the foot and the hand.

As illustrated in FIG. 16, the player can lie on the ground one one foot stopped at one handle 7 and one hand secured to the second handle 7, and then the multipurpose exercising apparatus is stretched by the foot.

While only one embodiment of the present invention has been shown and described, it will be understood that various modifications and changes could be made without departing from the spirit and scope of the invention.

I claim:

1. A multipurpose exercising apparatus comprising:

a first actuating device, said first actuating device comprising a cylindrical casing and a circular coupling at one end of the cylindrical casing, the circular coupling of said first actuating device comprising a partition wall, a center axle hole through the center of the partition wall, an outer chamber and an inner chamber separated by the partition wall, a stop block inside the inner chamber;

a second actuating device, said second actuating device comprising a cylindrical casing and a circular coupling at one end of the cylindrical casing, the circular coupling of said second actuating device comprising a partition wall, a center axle hole through the center of the partition wall of said second actuating device, an outer chamber and an inner chamber separated by the partition wall of said second actuating device, a stop block inside the inner chamber of said second actuating device;

a connecting device to connect the circular coupling of said first actuating device and the circular coupling of said second actuating device together, said connecting device comprising a locating device, a coil spring, a connecting bolt, two axle bushes, an adjusting knob, a clamp, a gasket, and a cap, said locating device comprising a circular head, a shank perpendicularly extended from the center of the circular head of said locating device and inserted through said coil spring and terminating in a reduced end, a circular end place coupled to said reduced end and disposed in parallel to the circular head of said locating device, a square center through hole through the head, shank, and end plate of said locating device, said connecting bolt comprising a circular head stopped against the partition wall of the circular coupling of said second actuating device, a square shank perpendicularly extended from the center of the circular head of said connecting bolt and inserted through the axle holes of the circular couplings of said first actuating device and said second actuating device, and a screw rod longitudinally extended from the square shank of said connecting bolt and having an annular groove around the periphery, said axle bushes being respectively mounted within the axle holes of the circular coupling of said first actuating device and said second actuating device around the square shank of said connecting bolt, said adjusting knob comprising a circular top recess and a screw hole at the center of the top recess, the screw hole of said adjusting knob being threaded onto the screw rod of said connecting bolt, said clamp being fastened to the annular groove on the screw rod of said connecting bolt and disposed inside the circular top recess of said adjusting knob, said gasket being mounted around the shank of said connecting bolt and retained between the circular coupling of said first actuating device and said adjusting knob, said cap being fitted into the circular top recess of said adjusting knob and covered over the screw rod of said connecting bolt;

a pair of first extension tubes respectively and slidably inserted into the cylindrical casings of said first actuating device and said second actuating device;

a pair of second extension tubes respectively and slidably inserted into said first extension tubes;

two handles respectively coupled to said second extension tubes, and disposed in parallel to each other; and two expansion springs respectively inserted through said first extension tubes and said second extension tubes, and connected between said handles and said actuating devices.

2. The multipurpose exercising apparatus of claim 1 wherein the partition wall of the circular coupling of each actuating device has two opposite sides respectively mounted with a plurality of resistance strips; the circular head of said locating device of said connecting device has a notch, which receives the stop block of the circular coupling of said first actuating device; the circular end plate of said locating device of said connecting device has a notch, which receives the stop block of the circular coupling of said second actuating device.

3. The multipurpose exercising apparatus of claim 1 wherein the cylindrical casing of each actuating device is comprised of half-round tubes connected together by screws and a nut, said half-round tubes having a respective threaded end abutted together and threaded into said nut.

4. The multipurpose exercising apparatus of claim 1 wherein the cylindrical casing of each actuating device has a locating rod on the inside adjacent to the respective circular coupling to hold the respective expansion spring.

5. The multipurpose exercising apparatus of claim 1 wherein the cylindrical casing of each actuating device is mounted with a respective lock for locking the respective first extension tube and second extension tube inside the respective cylindrical casing.

6. The multipurpose exercising apparatus of claim 1 wherein the cylindrical casing of each actuating device has two longitudinal sliding grooves on the inside for the sliding of the respective first extension tube; each first extension tube has two longitudinal ribs on the outside respectively moved in the longitudinal sliding grooves of the cylindrical casing of the respective actuating device, and two longitudinal sliding grooves on the inside for the sliding of the respective second extension tube; each second extension tube has two longitudinal ribs on the outside respectively moved in the sliding grooves on the respective first extension tube.

7. The multipurpose exercising apparatus of claim 1 wherein each handle comprises a coupling tube, a square extension tube, an adjusting bar, an expansion spring, and a sleeve, said coupling tube having a coupling end at right angles coupled to one second extension tube, a longitudinal square hole, a toothed portion at one side of the longitudinal square hole of said coupling tube, and a longitudinal side opening communicated with the longitudinal square hole of said coupling tube, the square extension tube of each handle being inserted into the longitudinal square hole of said coupling tube, having one end terminating in rounded locating rod at right angles stopped outside said coupling tube, the extension tube of each handle comprising two longitudinal side openings at two opposite sides, a first projecting strip upwardly suspended in one side opening of the square extension tube of the respective handle and having a hooked top end forced by said adjusting bar into engagement with the toothed portion of said coupling tube, a second projecting strip upwardly suspended in one side opening opposite to said first projecting strip and having a hooked top end projecting into the longitudinal side opening of said coupling tube, a transverse slot above one side opening, and a locating plate inserted into said transverse slot, said adjusting bar being inserted into the square extension tube of the respective handle, comprised of a square rod body at one end, a rounded stop rod section at an opposite end, and an outward square flange in the middle, said square rod body having a head and a spring mounted in a longitudinal hole at the center of the head and stopped below said locating plate, the expansion spring of each handle being mounted in the longitudinal square hole of the coupling tube of the respective handle and stopped above the respective locating plate, said sleeve being loosely mounted around said coupling tube.

* * * * *